United States Patent [19]

Young

[11] Patent Number: 4,730,422

[45] Date of Patent: Mar. 15, 1988

[54] INSULATING NON-REMOVABLE TYPE CONCRETE WALL FORMING STRUCTURE AND DEVICE AND SYSTEM FOR ATTACHING WALL COVERINGS THERETO

[75] Inventor: David A. Young, Glen Ellyn, Ill.

[73] Assignee: Young Rubber Company, Naperville, Ill.

[21] Appl. No.: 799,933

[22] Filed: Nov. 20, 1985

[51] Int. Cl.[4] ..... E04B 1/00; E04C 1/00

[52] U.S. Cl. ..... 52/105; 52/309.12; 52/426; 52/562

[58] Field of Search ..... 52/426, 427, 428, 562, 52/563, 564, 565, 568, 715, 698, 712, 105, 309.12

[56] References Cited

U.S. PATENT DOCUMENTS

| | | | |
|---|---|---|---|
| 644,176 | 2/1900 | Johnston | 52/712 |
| 2,268,311 | 12/1941 | Sheehan | 52/712 |
| 3,344,572 | 10/1967 | Sell | 52/426 |
| 3,788,020 | 1/1974 | Gregori | 52/426 |
| 4,157,640 | 6/1979 | Joannes | 52/309.12 |
| 4,263,765 | 4/1981 | Maloney | 52/562 |
| 4,329,821 | 5/1982 | Long | 52/309.12 |
| 4,655,014 | 4/1987 | Krecke | 52/426 |

FOREIGN PATENT DOCUMENTS

| | | | |
|---|---|---|---|
| 1484271 | 5/1969 | Fed. Rep. of Germany | 52/426 |
| 25530 | of 1896 | United Kingdom | 52/712 |
| 137221 | 1/1920 | United Kingdom | 52/426 |
| 1004061 | 9/1965 | United Kingdom | 52/715 |

OTHER PUBLICATIONS

The Condensed Chemical Dictionary ©1956, by Reinhold, p. 1172.

*Primary Examiner*—Henry E. Raduazo

*Attorney, Agent, or Firm*—Charles F. Meroni, Jr.

[57] ABSTRACT

A synthetic plastic concrete wall tie comprising a pair of triangular truss sections disposed in end-to-end relation, an intermediate web section joining the truss sections of the apexes of triangles of the triangular truss sections, and T-shaped end sections at opposite ends of the tie with each end section being formed integral with its stem joined with the associated triangular truss section, the cross piece of each T-shaped end section comprising means for anchoring the tie to a slotted wall section when assembled therewith.

The tie is usable with modular foamed plastic concrete form structure having a pair of modular concrete forming panels. The panels are comprised of a series of modular concrete forming sections stacked on top on one another in secured assembly and also disposed in end-to-end relation. The panels are positioned in spaced opposed relation with vertically spaced rows of T-shaped tie slots in the opposed sections positioned in longitudinally spaced transversely aligned relation along the upper and lower edges and which slots are hidden from view when viewing outer surfaces of the stacked sections. The ties hold the sections in assembly when secured in the tie slots. Tie locator indicia is provided on outer surfaces of the sections for providing for blind sighting to enable fasteners to be screwed through a wall covering, the indicia, the section and the synthetic plastic ties to securely anchor an exterior wall covering to the form structure after concrete has been poured therein.

20 Claims, 10 Drawing Figures

INSULATING NON-REMOVABLE TYPE CONCRETE WALL FORMING STRUCTURE AND DEVICE AND SYSTEM FOR ATTACHING WALL COVERINGS THERETO

BACKGROUND OF THE INVENTION

Field of the Invention

The present invention relates to a new and improved synthetic plastic concrete forming system. The present invention also concerns a new and improved synthetic plastic concrete wall tie for use in the concrete forming system. Still another part of the invention relates to a new and improved system and method for affixing wall coverings to a modular synthetic plastic concrete form structure.

According to certain other features of my invention, my new and improved synthetic plastic concrete wall tie has triangularly shaped openings provided in end-to-end disposed truss sections which allow concrete to flow laterally through triangular truss openings as concrete is poured into the form so that the ties do not act as dams to impede lateral flow of concrete in the form.

According to still other features of my invention, I have provided a new and improved synthetic plastic wall tie that has unique end formations which enable the wall tie to be easily attached with slotted form sections where the slots extend in rows along upper and lower edges of the form section.

Still other features of my invention are concerned with a new and improved synthetic plastic wall tie comprised of 20% calcium carbonate filled polypropylene of sufficient thickness to allow attachment screws to be threaded into opposite ends of the tie to anchor wall coverings to a poured concrete wall structure.

According to other important features of my invention, I have provided a new and improved synthetic plastic concrete wall tie which is totally modular in that it can be used and mounted in slots in wall sections synthetic plastic concrete forms from either edge of the tie.

According to still other important features of my invention, I have provided a new and improved synthetic plastic concrete wall tie having reinforcing rod locating fingers which assist in providing one or more pockets for a concrete reinforcing rod to minimize movement of the reinforcing rod as concrete is poured into the form.

In the past, it will be appreciated that different types of foamed plastic concrete forming systems have been used in industry and, in this connection, attention is drawn to U.S. Pat. Nos. 3,552,076 and 3,788,020. These patents relate generally to concrete forms formed from low density foamed plastic and polymeric material but where the forms do not possess the improvements herein described and illustrated.

SUMMARY OF THE INVENTION

In a modular synthetic foamed plastic concrete form structure, wherein the improvement comprises a pair of modular concrete impervious forming panels each comprised of a series of modular concrete forming sections stacked on top on one another and also disposed in end-to-end relation, the sections each having means on its upper and lower edges and its opposite vertical edges for interlocking the sections in stacked, end-to-end engagement with one another, the panels being positioned in spaced relation, vertically spaced rows of T-shaped tie slots in the opposed sections positioned in longitudinally spaced relation along the upper and lower edges and which slots are hidden from view when viewing outer surfaces of the stacked sections, synthetic plastic ties each having opposite enlarged T-shaped tie ends retainingly engaged in said T-shaped tie slots securing the sections in opposed spaced relation, the outer surfaces of the sections having tie locator indicia thereon for enabling fasteners to be screwed through the panel into the synthetic plastic ties to securely anchor exterior wall finishing covering to the sections.

A synthetic plastic concrete one piece load bearing form tie comprising a pair of triangular truss sections disposed in end-to-end relation, the truss sections each defining triangular truss openings of sufficient size to permit concrete to flow laterally therethrough, an intermediate web section joining the truss sections at the apexes of triangles of the triangular truss sections, and end attaching means at opposite ends of the tie formed integral with opposite ends of the tie, said attaching means at each end being for anchoring the tie to opposed wall section of a concrete form when assembled therewith, the truss sections each having a T-shaped end section at its outer end comprising means for anchoring the tie to a slotted wall section when assembled therewith, and with a cross-piece on each T-shaped end section being modular and disposed in parallel relation to the cross piece at the opposite end of the form tie, the end attaching means comprising a generally T-shaped tie end and having cross piece and stem portions positioned at right angles to one another, the cross piece portion providing a flat face positioned at right angles to a plane through said tie for engagement by a screw, the stem portion being at right angles to said flat face and being of sufficient thickness to provide an anchor for receiving a screw into its interior thus enabling an article to be attached by a screw in assembly with the T-shaped tie end.

In a modular formed plastic concrete form structure, wherein the improvement comprises a pair of modular concrete forming panels each comprised of a series of modular concrete forming sections stacked on top on one another and also disposed in end-to-end relation, the sections each having means on its upper and lower edges and its opposite vertical edges for interlocking the sections in stacked, end-to-end engagement with one another, the panels being positioned in spaced opposed relation, spaced T-shaped tie slots in the opposed sections and which slots are hidden from view when viewing outer surfaces of the stacked forming sections, tie locating indicia on outer surfaces of the forming sections for providing blind sighting means to enable screws to be screwed through a wall covering, the indicia, the forming section and into the synthetic plastic ties to securely anchor an exterior wall finishing covering to the forming sections, synthetic plastic wall ties for use with concrete forms, the wall having a pair of T-shaped end sections including a tie stem having a sufficient thickness for receiving an end of a screw in threaded engagement therewith, the T-shaped end sections having parallel cross pieces at opposite ends of the tie secured to said modular concrete forming sections, the tie cross piece having outer tie faces positioned generally at right angles to a plane through the length of the wall tie enabling said screw to be screwed through into the associated tie stem for attaching a wall covering thereto, the synthetic plaster ties being comprised of 20% calcium carbonate filled polypropylene which constitutes a material suitable for receiving a screw assembly therewith.

A method of securing a wall covering to a concrete wall structure, the steps of forming synthetic plastic wall forming sections from a foamed plastic material with rows of tie slots at spaced intervals along upper and lower edges and with indicia formed on outer wall surfaced of the forming section so that the indicia and the slots are transversely aligned in pairs along the edges enabling the indicia to act as a tell tale for the slots and wall ties, securing opposite ends of synthetic plastic concrete wall ties in the slots of the wall forming sections to provide a reinforced form structure, securing transverse closure sections between the wall forming sections to provide form closures, pouring concrete in the thus formed concrete forming structure and immersing and hiding the ties in the concrete, screwing fasteners through a wall covering, the panel section into the wall tie using the indicia as a blind concrete tie locator for aligning the screw with the hidden wall tie enabling the screw to be screwed into the tie to securely fasten the wall covering thereto.

DESCRIPTION OF THE PREFERRED EMBODIMENTS

Figure 1:
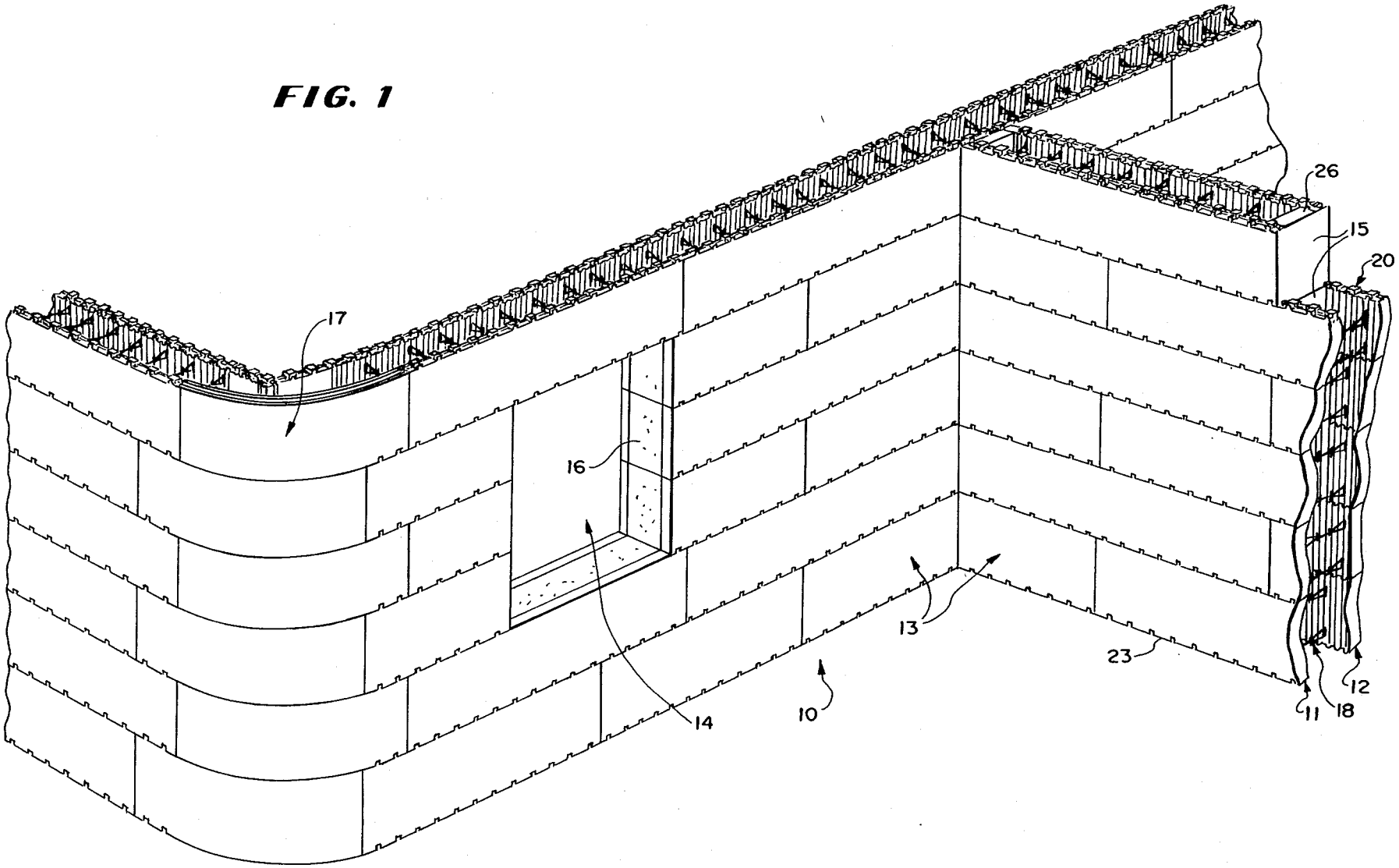
FIG. 1 is an enlarged fragmentary cross-sectional view of a modular foamed plastic concrete form structure embodying important features of my invention.

The reference numeral 10, as seen in FIG. 1, designates generally a modular foamed plastic concrete form structure. The structure that is shown in FIG. 1 is also shown in my co-pending U.S. application for patent entitled: "A PERMANENT NON-REMOVABLE INSULATING TYPE CONCRETE WALL FORMING STRUCTURE", our Ser. No. 799,932, filed 11-20-85 which is co-pending with the present application. The disclosure of my co-pending application is here incorporated by reference.

The structure 10 is comprised of a pair of modular concrete forming panels 11 and 12 which are spaced from one another and which when properly installed serve to act as a form into which concrete may be poured. The panels are each comprised of a series of modular concrete forming sections 13 which are all identical to one another with certain exceptions, as hereafter described. These sections are adapted to be cut and arranged so as to enable window openings 14 to be easily constructed. Cooperable with the panels 11 and 12 are end closure panels 15 which extend transversely between the forming panels 11 and 12 and between the forming sections 13 so as to confine poured concrete. It will further be seen that the window openings 14 are also provided with closure panels 16. All of the panels 11, 12, the sections 13, the closure panels or end pieces 15, the window panels 16 and curved corner panels 17 are comprised of foamed plastic preferably an expandible polystyrene. This material has been found to have unique insulating properties and strength so as to enable concrete walls to be better insulated to impede transmission of heat through a formed wall as will be further described at another point herein.

In order to properly reinforce the concrete forming structure 10, I have developed a new and improved wall tie 18 which is comprised of 20% calcium carbonate filled polypropylene as a preferred embodiment.

My thermal wall system is a whole new concept in energy efficient building technology. The building block sections of expanded polystyrene serve as a permanent form for concrete. This system of construction is for use where energy conservation is for use where energy conservation and speed of construction are important.

Expanded polystyrene or EPS is a closed cell, rigid, lightweight cellular plastic, white in color, that is molded into various shapes with steam and pressure. Thermal wall system panels are made of modified polystyrene. The density of the panels range between 1.7 and 2.0. Typical physical properties of EPS insulation is given in Table 1 below. Like all organic materials, EPS is combustible and should not be exposed to flame or other ignition sources.

TYPICAL PHYSICAL PROPERTIES OF EPS

| | | | | Density (pcf) | | | |
|---|---|---|---|---|---|---|---|
| Property | | Units | ASTM Test | 1.0 | 1.25 | 1.5 | 2.0 |
| Thermal Conductivity | at 25 F. | BTU/(hr) | C177 or | 0.23 | 0.22 | 0.21 | 0.20 |
| K Factor | at 40 F. | (sq ft)(F/in) | C518 | 0.24 | 0.235 | 0.22 | 0.21 |
| | at 75 F. | | | 0.26 | 0.255 | 0.24 | 0.23 |
| Thermal Resistance | at 25 F. | at 1 inch | — | 4.35 | 4.54 | 4.76 | 5.00 |
| Values (R) | at 40 F. | thickness | | 4.17 | 4.25 | 4.55 | 4.76 |
| | at 75 F. | | | 3.85 | 3.92 | 4.17 | 4.35 |

-continued

| Property | Units | ASTM Test | Density (pcf) 1.0 | 1.25 | 1.5 | 2.0 |
|---|---|---|---|---|---|---|
| Strength Properties | | | | | | |
| Compressive 10% Deformation | psi | D1621 | 10–14 | 13–18 | 15–21 | 25–33 |
| Flexural | psi | C203 | 25–30 | 32–38 | 40–50 | 55–75 |
| Tensile | psi | D1623 | 16–20 | 17–21 | 18–22 | 23–27 |
| Shear | psi | D732 | 18–22 | 23–25 | 26–32 | 33–37 |
| Shear Modulus | psi | — | 280–320 | 370–410 | 460–500 | 600–640 |
| Modulus of Elasticity | psi | — | 180–220 | 250–310 | 320–360 | 460–500 |
| Moisture Resistance | | | | | | |
| WVT | perm in | C355 | 12–30 | 1.1–2.8 | 0.9–2.5 | 0.6–1.5 |
| Absorption (vol) | percent | C272 | less than 2.5 | less than 2.5 | less than 2.0 | less than 1.0 |
| Capillarity | — | — | none | none | none | none |
| Coefficient of Thermal Expansion | in/(in.) (F.) | D696 | 0.000035 | 0.000035 | 0.000035 | 0.000035 |
| Maximum Service Temperature | °F. | — | | | | |
| Long term | | | 167 | 167 | 167 | 167 |
| Intermittent | | | 180 | 180 | 180 | 180 |

Figure 10:
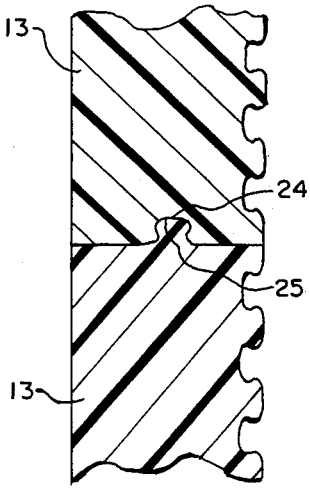
FIG. 10 is an enlarged fragmentary horizontal section of a pair of panels connected in end-to-end relation.

All values based on data available from American Hoechst Corporation ARCO Chemical Company and BASF Wyandotte Corporation The basic building components my thermal wall system are the two solid 2" panels 11 and 12 of polystyrene connected together with high impact plastic ties 18. the length of the tie 18 determines the width of the concrete wall. Each block or section 13 has castellations 20 along its top edge or surface 21 and matching castellations along its under edge 23 (FIG. 1). The blocks or sections 13 are placed one on top of the other and pressed together using simple hand pressure. The castellations mesh together creating a completely smooth surface that is interlocked. The vertical ends of the block or section 13 are tongue 24 and groove 25 (FIG. 10) and interlock as well. The blocks or sections 13 are erected directly on top of footings or on the floor slat, as design dictates. The footing must be level and flat. When placing concrete, particular care should be taken in the first lift to check the horizontal and vertical levels.

Figure 8:
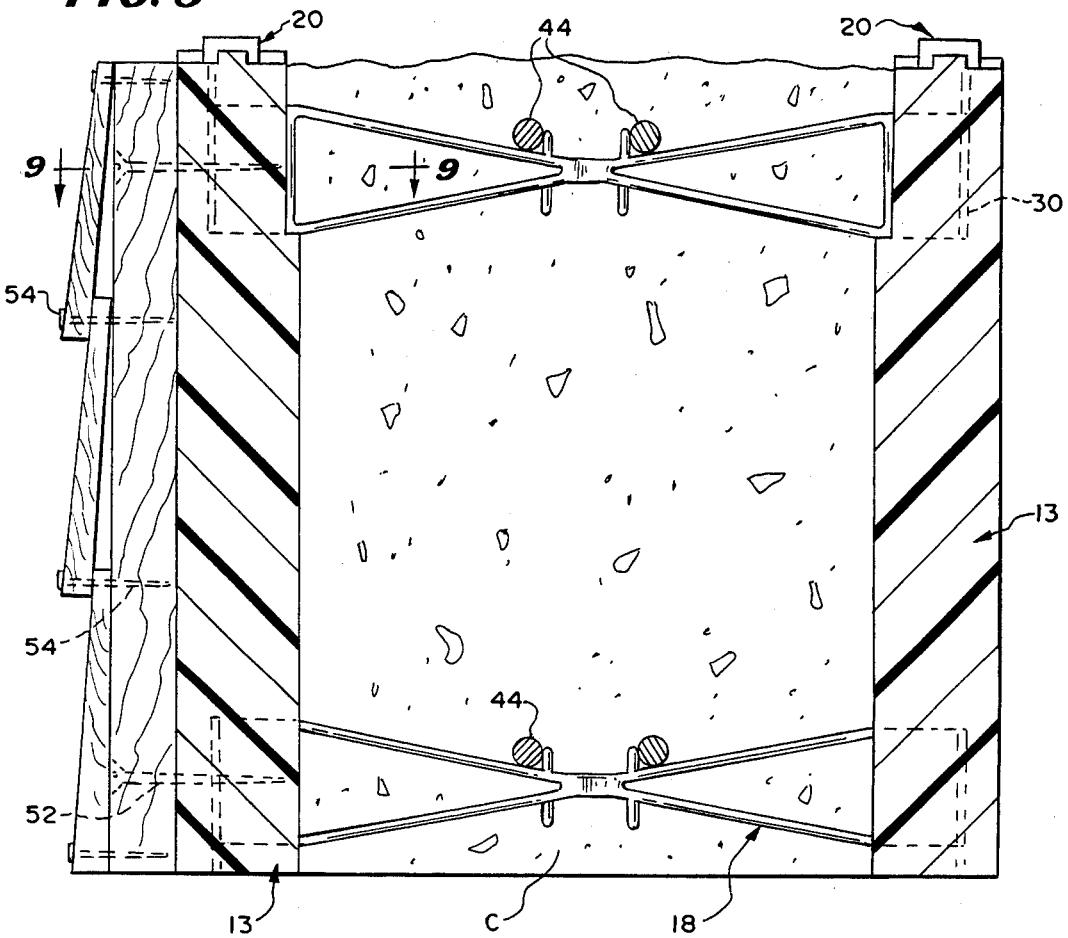
FIG. 8 is an enlarged fragmentary vertical section through a concrete filled modular synthetic plastic concrete form structure further showing how a wall covering may be attached to the modular concrete forming sections.

Each of the end closures 15 vertically extending alternating hooked shaped ribs and grooves generally indicated at 26 which are shaped like and complimentary to hook shaped ribs 27 and hooked shaped grooves 28 (FIG. 8) to enable opposite ends of the end closures 15 to be slid into interlocked assembly with the opposed sections 13, 13. The sections have the ribs 27 and grooves 28 formed integral with the associated section 13 and when set up, the ribs 27 and the grooves 28 on the opposed panels 11 and 12 confront one another.

Figure 2:
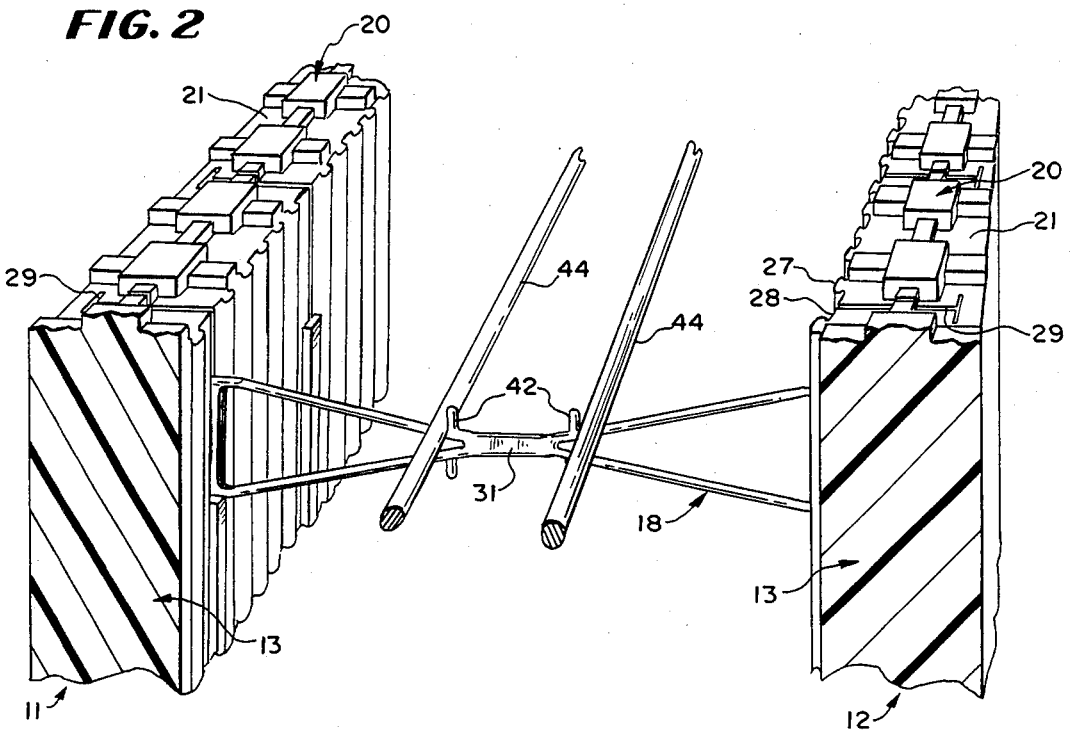
FIG. 2 is an enlarged perspective view partially in section showing a concrete form structure with reinforcing rods mounted therein.
Figure 3:
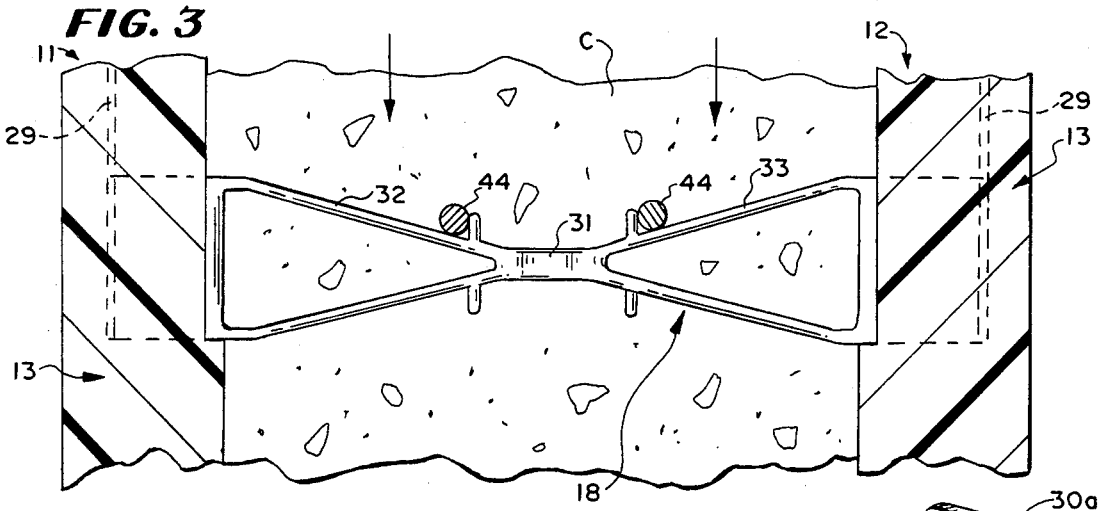
FIG. 3 is an enlarged vertical section of a concrete filled modular synthetic plastic concrete form structure embodying still further features of my invention.

The ties 18 are adapted to coact with upper and lower rows of T-shaped slots 29 which are formed in each of the sections 13. The slot 29 opens on an inner side so that the T-shaped slots oppose one another when two sections 13—13 are placed in opposed relation such as is shown in FIG. 2. The ties 18 are provided with T-shaped tie ends 30—30 which have a configuration that matches the shape of the slots 29 so as to be slideably engageable together when assembled with the sections. The ties 18 when engaged with the opposed sections along their upper and lower edges provide a sturdy concrete form structure.

Figure 4:
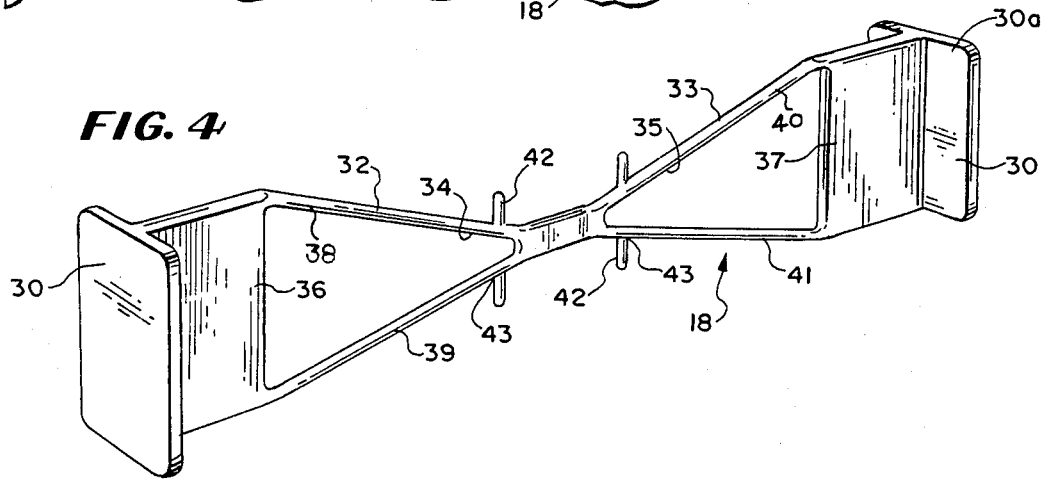
FIG. 4 is an enlarged perspective view of a wall tie like the tie shown in FIGS. 2 and 3.
Figure 5:
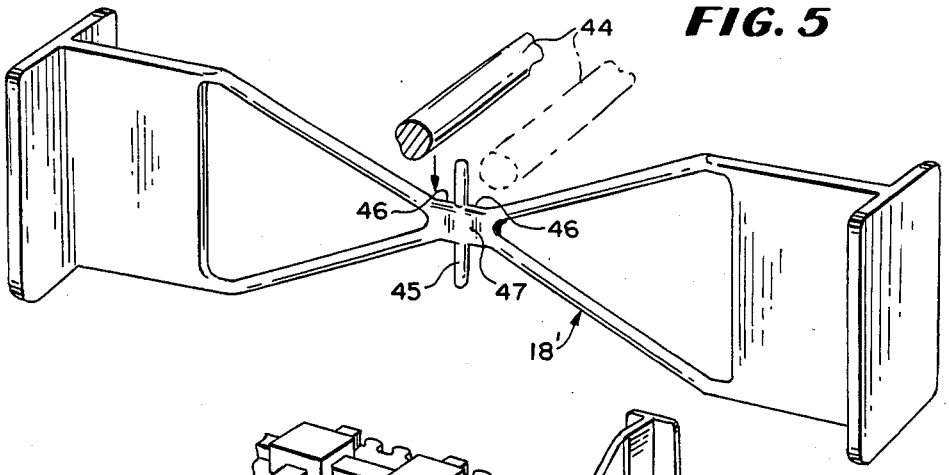
FIG. 5 is an enlarged perspective view of a modified type of wall tie similar to the one shown in FIG. 4 with a reinforcing rod being shown in dotted and full lines for being supported upon the tie.

It will be noted from comparing FIGS. 4 and 5 that there are two different types of ties and these ties have been identified as ties 18 and 18'. The ties 18 and 18' are essentially identical except that the tie 18' is a shorter tie and can be used where narrower concrete walls are to be formed such as having a thickness of 8". The longer ties 18 are adapted to be used in the formation of concrete walls having a thickness of 10". The length of the ties can be varied are required. The ties 18 are similar in construction to the ties 18' and the differences will be pointed out hereafter.

With respect to the ties 18, each tie has an intermediate or mid-web section 31', and a pair of triangular truss sections 32 are disposed on opposite ends of the mid-section 31' in integral one piece assembly therewith. The intermediate web section 31' joins the truss sections at the apexes of triangles of the triangular truss sections. As stated, the triangular truss sections 32 and 33 define triangular truss openings 34 and 35. It is these openings that have been created to enable concrete to flow freely through the ties in an unimpeded manner so that the ties will not act as dams to confine the flow of liquid concrete in the molds or forms as the concrete is poured.

The triangular truss sections 32 and 33 terminate in end truss portions 36 and 37 which in turn merge into the T-shaped tie ends 30—30. Each of the tie ends includes a cross piece portion **30*a* and a stem portion 30*b*. The truss sections are further defined by truss legs 38, 39, 40 and 41** which are all preferably of a diameter of approximately 3/16".

The ties 18 are also provided with upstanding fingers 42—42 with a pair of the fingers being mounted on each edge of the tie and more particularly are joined to adjacent truss legs. The fingers 42 coact with the truss legs so as to form V-shaped notches 43 for receiving reinforcing rods 44. It has been found that where the ties are constructed so as to be provided with the fingers 42 defining the notches 43 that the concrete rods 44 can be more fixedly located at the point in time when the liquid concrete is poured into the form so that the reinforcing rods will not bounce and move as the concrete C is poured thereon.

The shorter tie 18' differs from the tie 18 in that it is only provided with a single pair of upstanding fingers 45 and these fingers extend above and below tie mid-section 47 as shown in FIG. 5. The fingers 45 and the mid-section 47 coact together to define notches on opposite sides of the fingers so that when the concrete rods 44 are engaged in the notches, the rods can be more positively fixed relative to the ties so that the rods will not laterally shift when concrete is poured thereon.

Figure 6:
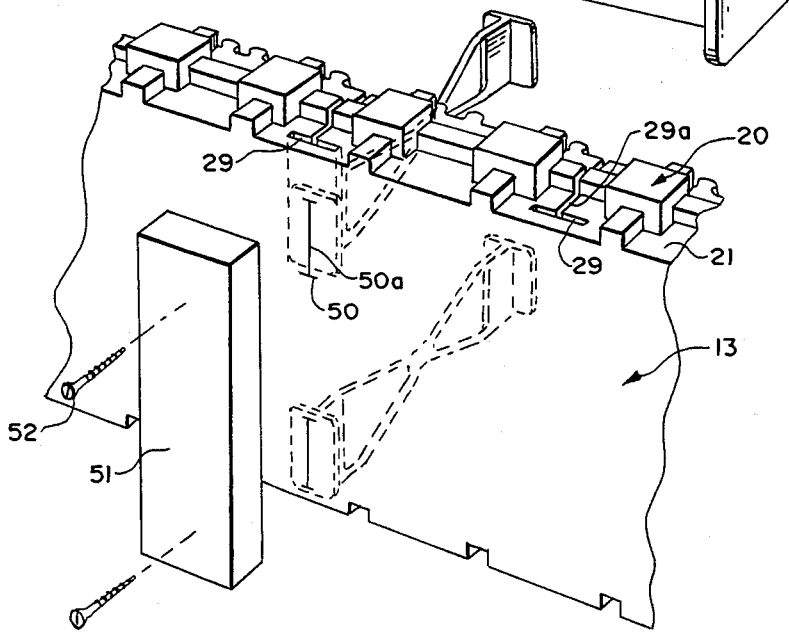
FIG. 6 is an exploded fragmentary vertical section of a modular synthetic plastic concrete form structure and illustrating the manner by which wall coverings can be attached thereto.

According to other important features of my invention, I have provided embossed I-shaped indicia 50 as seen in FIG. 6. The embossed I-shaped indicia 50 are vertically spaced in rows on an outer face adjacent to upper and lower edges of each section 13 in transverse alignment with the T-shaped slots 29 that open on the opposite surface or face of the section 13. The embossed I-shaped indicia 50 have an upstanding portion 58 that is in transverse alignment with a stem portion 29a of the notch 29 (FIG. 6).

The embossed I-shaped indicia 50 is provided on both sides of the section and opposite each row of the T-shaped slots and the spacing of the embossed I-shaped indicia may be varied as required. This spacing of the indicia may be of the order of every 6" along the length of the section.

Figure 7:
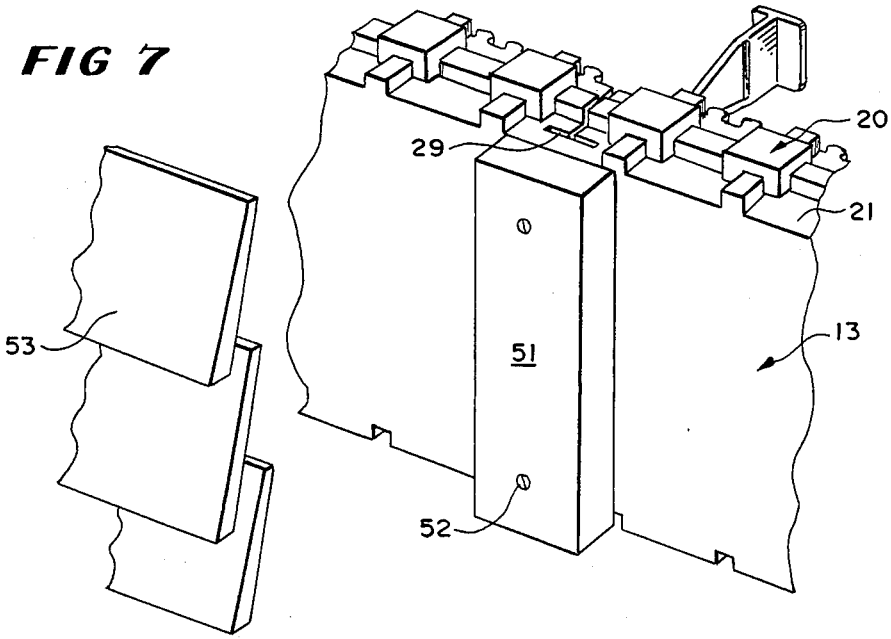
FIG. 7 is an enlarged fragmentary exploded view of a modular synthetic plastic concrete form structure similar to that shown in FIG. 6 only with the components being in a more advanced stage of assembly.
Figure 9:
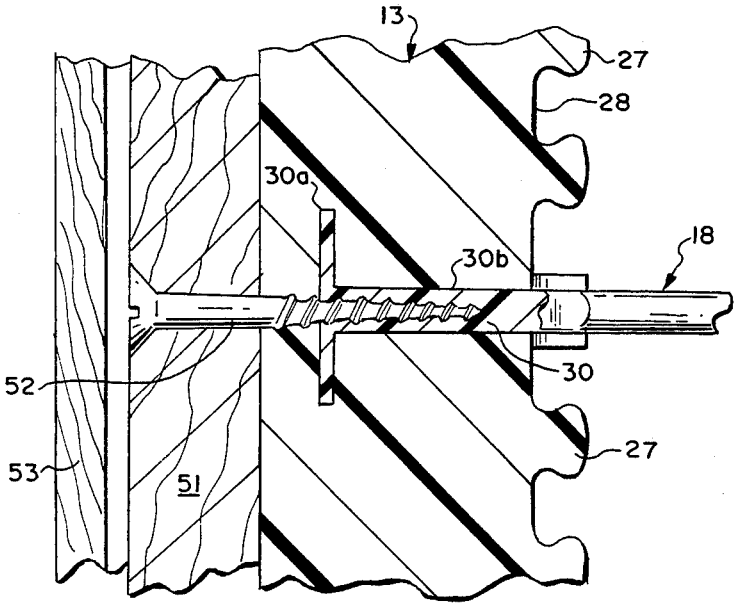
FIG. 9 is an enlarged fragmentary section taken on line 9—9 looking in the direction indicated by the arrows as seen in FIG. 8.

The embossed I-shaped indicia 50 serves as a "tell tale" or as a "blind slot locator" to enable furring strips 51 to be attached by screws 52 (FIGS. 7–9) in such a way that the screws can be screwed directly into the ties 18 and, more particularly, through the T-shaped end 30 of the tie to firmly anchor the furring strip 51 to the section 13. Thereafter, a wall covering 53 can be suitably attached to the furring strips 51 by additional screw fasteners as indicated at 54 in FIG. 8.

The ties 18 and 18' otherwise identified as the long tie 18 and the short tie 18' are preferably constructed having the following approximated dimensions:

| | Length of Tie | Height of Tie | Thickness of Flat End | Width of Stem of T-shaped End |
|---|---|---|---|---|
| Long Tie | 11" | 2 3/16" | 3/16" | 1 5/16" |
| Short Tie | 9" | 2 3/16" | 3/16" | 1¼" |

| | Width of Intermediate Truss Section | Length of Finger | Diameter of Finger |
|---|---|---|---|
| Long Tie | 1 13/16" | ⅝" | 3/16" |
| Short Tie | 1¼" | ⅝" | 3/16" |

| | Length of Vertical Truss Legs | Length of Diagonal Truss Legs | Diameter of Diagonal Truss Legs |
|---|---|---|---|
| Long Tie | 1¾" | 3 1/16" | 3/16" |
| Short Tie | 1¾" | 2 3/8" | 3/16" |

The ties 18 have been tested and have been found to have the following approximated test characteristics:

TEST STUDY OF CALCIUM CARBONATE FILLED POLYPROPYLENE TIES

| PROPERTY | UNIT | ASTM METHOD | LPP6020 (20%) | LPP6030 (30%) |
|---|---|---|---|---|
| Tensile Strength at 73° F. | psi | D638 | 4,000 | 3,500 |
| Elongation at Break | % | D638 | 80 | 70 |
| Flexural Strength at 73° F. | psi | D790 | 4,800 | 4,950 |
| Flexural Modulus (tangent) | psi × $10^5$ | D790 | 2.6 | 2.9 |
| Flexural Modulus (1% Secant) | psi × $10^5$ | | 2.4 | 2.6 |
| Izod Impact at 73° F. Notched (½" × ⅛" bar) | ft/lb/in. | D256(1) | .75 | .8 |
| Izod Impact at 73° F. Unnotched (½" × ⅛" bar) | ft-lb/in. | D256 | 12 | 15 |
| Gardner Impact | in-lb. | — | 20 | 30 |
| Heat Deflection Temperature, 66 psi | °F. | D648 | 210 | 220 |
| Specific Gravity | — | D792 | 1.05 | 1.14 |
| Hardness, Shore "D" | — | D2240 | 72 | 73 |
| Melt Flow | g/10 min. | D1238(2) | 4–6 | 4–6 |
| Mineral Content | % | —(3) | 20 | 30 |

-continued

TEST STUDY OF CALCIUM CARBONATE FILLED POLYPROPYLENE TIES

| PROPERTY | UNIT | ASTM METHOD | LPP6020 (20%) | LPP6030 (30%) |
|---|---|---|---|---|
| Mold Shrinkage | in/in | — | .012 | .011 |

(1) Method A
(2) Condition L"L
(3) Burn-out at 850° F.
Mold Shrinkage is intended as a guide only, as specific shrinkage is affected by part design, mold design, and molding conditions.
The values listed herein are to be used as guides, not as specification limits. Determination of product suitability in any given application is the responsibility of the user.

My thermal wall structure introduces a new building product made of expandable polystyrene which serves as a permanent form for concrete construction. This products main advantages are its speed of erection and the very high thermal insulation properties attained (R-Value of 20+).

Similar products have been used extensively in Switzerland, Belgium, France, Germany, Venezuela, Australia and now the United States. It has been in use for nearly 20 years. It is a simple building system: Hollow blocks made of ARCO Dylite Expandable Polystyrene, with a flame retardant additive, are erected "Lego" fashion by means of their toothed tops and grooved bottoms. Plastic ties hold the sides together and the length of the tie determines the width of the cavity or wall, the blocks are interlocked both horizontally and vertically. Once erected, concrete is poured into the cavity of the wall creating an insulated load bearing structure.

My thermal wall building blocks or sections 13 are composed of panels of EPS (Expandable Polystyrene) that are 2" thick, 12" high and 40" or 20" long. The density is nearly twice that of conventional insulated board. A whole range of exterior finished can be applied. Scores of elastomeric coatings and stucco finishes may be used as well as siding or paneling. Interiors are finished with drywall, plaster, tile or in any other traditional manner.

My thermal wall structure is an advanced system of construction for use where energy conservation (by reduction of thermal transmission) and speed of construction (reduced labor costs) are important.

The inherent low thermal fluctuations ensure that the risk of cracking of any external rendering and internal plaster-work are non-existent. The maximum possible expansion if 0.2 mm/m.

Excellent noise and impact sound reduction is also an important advantage of the Thermal Wall System. Remembering that a difference of 10 dB almost halves the volume of noise. 350 Ka/m2 Thermal Wall 250 mm is at 49 dB.

Expandable Polystyrene does not rot and when used properly in building construction it is not subject to any other kind of deterioration while in service.

Panels of "Dylite" Expandable Polystyrene are 2" thick, 12" high and 40" or 20" long. The horizontally spaced rows of "t" or T-shaped slots 29 are disposed along the top and bottom of each section. T-shaped ends 30—30 of the ties 18 are inserted into the slots 29. These ties 18 hold the sections 13 and the panels 11 and 12 together and also determine the width of the wall. Each blocks or sections 13 have the castellations 20 along its top surface and matching castellations along the underside as previously described. The blocks 13 are placed on on top of the other and pressed together using simple pressure; the castellations mesh together creating a completely smooth surface and solid structure. The blocks are erected directly on top of footings or on a floor slab, as design dictates. The footings must be as level and flat as possible. When pouring concrete, particular care should be taken in the first three feet poured to check the horizontal and vertical levels, this is most important, as small errors and variations in the early levels will be greatly increased in height. The lightness of the blocks or sections 13 and the flexibility of them means erection can be both fast and simple.

For corners, windows, door openings and t-junctions a uniquely configurated "endpiece" is also made of expandable polystyrene and is inserted into the end of the block. It slides into the block and acts as a bulkhead for concrete. It is held in place by surface corrugations on the insides of the block panels.

90° corners are formed by interlocking blocks perpendicular to one another and inserting endpieces to bulkhead the concrete. With a 10 inch wall rounded corners are available by use of my specially made corner block or section 17.

Thermal wall blocks or sections 13 can be cut quickly and easily with any conventional hand saw. Sanding down the edge with a coarse abrasive block ensures a smooth tight fit.

The blocks or sections 13 are stacked to the desired height of 8 to 10 foot and are filled with regular concrete by means of a concrete truck and chute or with a concrete pump. A super plasticizer additive is recommended to aid in flowability of the concrete mix without detriment to the strength of the concrete. The concrete should be placed in "lifts" or layers of 4 foot, at a rate of 8 to 10 foot per hour.

ELECTRIC AND PLUMBING

Water supply lines and conduit for electric can be easily cut into the 2" thickness of the thermal wall, after the concrete has been poured. They are then covered with drywall or plaster. Pipes of greater diameter than 2", such as waste water pipes, should be placed in the wall cavity before the concrete is poured. Completely surrounded by concrete and thermal wall polystyrene, the pipe will be insulated and insensitive to frost even if the building is unheated.

The use of thermal wall blocks or sections 13 in construction makes possible the type of energy-efficient construction that is necessary today (and will be even more so in the future judging from the ever-increasing energy costs).

EPS (Expandable Polystyrene) panels 11 and 12 are connected together with the plastic ties 18 to form building blocks. These blocks interlock horizontally and vertically and are stacked one upon another to a desired height and filled with concrete.

The blocks remain in place after the concrete has been poured and provides the structure with an R-Value of 20.

R-Value means the resistance to heat loss and the R system is a way of rating insulation effectiveness: the higher the R-Value the greater the resistance provided against heat and cold.

T.W.S. blocks are formed from ARCO—"Dylite", a fire retardant EPS, and will not support combustion.

There are no limits to the types of wall coverings, both interior and exterior that may be applied. Generally the exterior is of a cemeticious finish and the interior is plastered or drywalled. Panels may be glued or screwed.

SOME OF THE ADVANTAGES

1. Rated R-20+: Stretches Energy Dollars.
2. Concrete cures under ideal conditions, down to −10 degrees C. and use of the sections 13 operates to extend the building season.
3. By using the sections 13 in block form, heating and air conditioning costs can be reduced by 50%.
4. The sections 13 and the formed blocks are fire retardant and will not support combustion.
5. Sound Proof.
6. Water Repellant.
7. Mold and mildew resistant and rot proof.
8. The sections 13 have no food value and insects cannot digest it.
9. The sections 13 are versatile and can be used both above and below grade for residential, multi-family and commercial construction, as well as high-rise construction.
10. My forms are lightweight and the interlocking procedures enable increased productivity with less construction time.
11. The sections and the formed blocks are air tight and voids and air filtration are virtually eliminated.
12. Wall thickness may vary from 6, 8 or 10" based on length of ties.
13. The rounded corner sections allow for increased design possibilities with no additional framing costs.
14. There is a complete absence of cracking of internal and external finishes and maximum possible expansion is 0.2 mm/m.
15. Use of my concrete forms enable a quicker return on Investment Dollars.

LIMITATIONS (a) Loading:

Thermal wall panels should not be installed under surfaces subject to heavy point loading; the E.P.S. does not add structural integrity to the wall; it simply insulates it.

(b) Solvents:

E.P.S. including thermal wall panels can not be exposed to petroleum-based solvents, fuels or coal tar products and their vapors.

(c) Ultraviolet Degredation:

Prolonged exposure to sunlite (Ultraviolet rays) will cause E.P.S. material to discolor and a dusting of the surface will occur. Wall panels must be covered to prevent degredation.

(d) Flammability:

The E.P.S. material used in forming thermal wall panels has a flame retardant additive but it should be considered combustable when directly exposed to a constant source of flame. It should be installed near an open flame or other source of ignition. Current model building code requirements should be met for adequate protection.

I claim:

1. In a modular formed plastic concrete form structure, wherein the improvement comprises a pair of modular concrete forming panels each comprised of a series of modular concrete forming sections stacked on top on one another and also disposed in end-to-end relation, the sections each having means on its upper and lower edges and its opposite vertical edges for interlocking the sections in stacked, end-to-end engagement with one another, the panels being positioned in spaced opposed relation, spaced T-shaped tie slots in the opposed sections and which slots are hidden from view when viewing outer surfaces of the stacked forming sections, tie located indicia on outer surfaces of the forming sections for providing blind sighting means to enable screws to be screwed through a wall covering, the indicia, the forming section and into the synthetic plastic ties to securely anchor an exterior wall finishing covering to the forming sections, synthetic plastic wall ties for use with concrete forms, the wall having a pair of T-shaped end sections including a tie stem having a sufficient thickness for receiving an end of a screw in threaded engagement therewith, the T-shaped end sections having parallel cross pieces at opposite ends of the tie secured to said modular concrete forming sections, the tie cross pieces having outer tie faces positioned generally at right angles to a plane through the length of the wall tie enabling said screw to be screwed through into the associated tie stem for attaching a wall covering thereto.

2. The form structure of claim 1 further characterized by concrete rod locator means being provided along a top edge of the tie defining a pair of side-by-side V-shaped notches for receiving concrete tie rods to resist movement of the concrete tie rods as concrete is poured thereon, the wall tie having a thickness approximately 3/16".

3. The one piece load bearing form tie of claim 1 further characterized by the tie being comprised of 20% calcium carbonate filled polypropylene and having a length of 11", a width of 3/16", and a height of 2 3/16".

4. The one piece load bearing form tie of claim 1 further characterized by the tie being comprised of 20% calcium carbonate filled polypropylene and having a length of 9", a width of 3/16", and a height of 2 3/16".

5. The form structure of claim 1 further characterized by the tie locator indicia comprising longitudinally extending rows of I-shaped embossments extending along upper and lower edges of each section.

6. The form structure of claim 1 further characterized by the tie locator indicia comprising longitudinally extending rows of I-shaped embossments extending along upper and lower edges of each section, each embossment being transversely aligned with one of the slots.

7. In a modular foamed plastic concrete form structure, wherein the improvement comprises a pair of modular concrete forming panels each comprised of a series of modular concrete forming section stacked on top on one another and also disposed in end-to-end relation, the sections each having means on its upper and lower edges and its opposite vertical edges for interlocking the sections in stacked, end-to-end engagement with one another, the panels being positioned in spaced opposed relation, vertically spaced rows of T-shaped tie slots in the opposed sections positioned in longitudinally spaced aligned relation along the upper and lower edges and which slots are hidden from view when viewing outer surfaces of the stacked sections, tie locator indicia on outer surfaces of the sections for providing blind sighting means to enable fasteners to be screwed through a wall covering, the indicia, the section and into the synthetic plastic ties to securely anchor an exterior wall finishing covering to the sections, and synthetic plastic concrete load bearing wall ties each comprised of one piece and having T-shaped opposite ends engageable in said T-shaped tie slots, the T-shaped opposite ends being separated from one another by a pair of triangularly shaped truss sections positioned in end-to-end relation.

8. The form structure of claim 7 further characterized by the triangular truss sections each having triangularly shaped openings to allow concrete to flow laterally therethrough in an unimpeded manner.

9. The form structure of claim 7 further characterized by the tie being of a modular construction and being reversibly installable with concrete wall sections with either of its spaced horizontal edges being on top of the other edge.

10. A synthetic plastic concrete one piece load bearing form tie comprising a pair of triangular truss sections disposed in end-to-end relation, the truss sections each defining triangular truss openings of sufficient size to permit concrete to flow laterally therethrough, an intermediate web section joining the truss sections at the apexes of triangles of the triangular truss sections, and end attaching means at opposite ends of the tie formed integral with opposite ends of the tie, said attaching means a concrete form when assembled therewith, the truss sections each having a T-shaped end section at its outer end comprising means for achoring the tie to a slotted wall section when assembled therewith, and with a cross piece on each T-shaped end section being modular and disposed in parallel relation to the cross piece at the opposite end of the form tie, the end attaching means comprising a generally T-shaped tie end and having cross piece and stem portions positioned at right angles to one another, the cross piece portion providing a flat face positioned at right angles to a plane through said tie for engagement by a screw, the stem portion being at right angles to said flat face and being of sufficient thickness to provide an anchor for receiving a screw into its interior thus enabling an article to be attached by a screw in assembly with the T-shaped tie end.

11. In a modular foamed plastic concrete form structure, wherein the improvement comprises a pair of modular concrete forming panels each comprised of a series of modular concrete forming sections stacked on top on one another and also disposed in end-to-end relation, the sections each having means on its upper and lower edges and its opposite vertical edges for interlocking the sections in stacked, end-to-end engagement with one another, the panels being positioned in spaced opposed relation, vertically spaced rows of T-shaped tie slots in the opposed sections positioned in longitudinally spaced aligned relation along the upper and lower edges and which slots are hidden from view when viewing outer surfaces of the stacked sections, tie locator indicia on outer surfaces of the sections for providing blind sighting means to enable fasteners to be screwed through a wall covering, the indicia, the section and into the synthetic plastic ties to securely anchor an exterior wall finishing covering to the sections, and synthetic plastic concrete load bearing wall ties each comprised of one piece and having T-shaped opposite ends engageable in said T-shaped tie slots, the T-shaped opposite ends being separated from one another by a pair of triangularly shaped truss sections positioned in end-to-end relation the tie locator indicia being I-shaped in configuration.

12. The form structure of claim 11 further characterized by the tie locator indicia comprising longitudinally extending rows of I-shaped embossments extending along upper and lower edges of each section.

13. The form structure of claim 11 further characterized by the tie locator indicia comprising longitudinally extending rows of I-shaped embossments extending along upper and lower edges of each seciton, each embossment being transversely aligned with one of the slots.

14. A one piece synthetic plastic load bearing form tie comprising a pair of triangular truss sections disposed in end-to-end relation, an intermediate web section joining the truss sections, and only one T-shaped end section at each end of the tie with each end section being formed integral with its stem joined with the associated triangular truss section, a cross piece of each T-shaped end section comprising means for anchoring the tie to a slotted wall section when assembled therewith and with the cross pieces on each form tie being modular and disposed in parallel relation to one another load bearing form, modular V-shaped notches provided thereon along upper and lower surfaces providing locator means for enabling reinforcing rods to be carried in the turned up notches so that movement of the concrete reinforcing rods can be minimized as concrete is poured into the concrete form structure having one or more of the concrete reinforcing rods mounted therein.

15. A one piece synthetic plastic load bearing form tie comprising a pair of triangular truss sections disposed in end-to-end relation, an intermediate web section joining the truss sections, and only one T-shaped end section at each end of the tie with each end section being formed integral with its stem joined with the associated triangular truss section, a cross piece of each T-shaped end section comprising means for anchoring the tie to a slotted wall section when assembled therewith and with the cross pieces on each form tie being modular and disposed in parallel relation to one another load bearing form, concrete tie locator means being provided along upper and lower edges of the tie so that the concrete locator means on its topside edge can restrict movement of the concrete tie as concrete is poured thereon, said locator means including at least one upstanding finger-like projection molded integal with the tie.

16. A one piece synthetic plastic load bearing form tie comprising a pair of triangular truss sections disposed in end-to-end relation, an intermediate web section joining the truss sections, and only one T-shaped end section at each end of the tie with each end section being formed integral with its stem joined with the associated triangular truss section, a cross piece of each T-shaped end section comprising means for anchoring the tie to a slotted wall section when assembled therewith and with the cross pieces on each form tie being mdoular and disposed in parallel relation to one another load bearing form, concrete tie locator means being provided along at least one edge of the tie to restrict movement of the concrete tie as concrete is poured thereon, said locator means including a pair of upstanding finger-like projections molded integral with the tie and extending upwardly from said one edge.

17. A one piece synthetic plastic load bearing form tie comprising a pair of triangular truss sections disposed in end-to-end relation, an intermediate web section joining the truss sections, only one T-shaped end section at each end of the tie with each end section being formed integral with its stem joined with the associated triangular truss section, a cross piece of each T-shaped end section comprising means for anchoring the tie to a slotted wall section when assembled therewith and with the cross pieces on each form tie being modular and disposed in parallel relation to one another load bearing form, concrete tie locator means being provided along upper and lower edges of the tie so that the concrete tie locator means on its topside edge can restrict movement of the concrete tie as concrete is poured thereon, said locator means on each edge comprising at least two upstanding longitudinally spaced finger-like projections molded integral with the tie.

18. A synthetic plastic concrete form tie comprising a pair of triangular truss sections disposed in end-to-end relation, the truss sections each defining triangular truss openings of sufficient size to permit concrete to flow laterally therethrough, an intermediate web section joining the truss sections at the apexes of triangles of the triangular truss sections, end attaching means at opposite ends of the tie formed integral with opposite ends of the tie, said attaching means at each end being for anchoring the tie to opposed wall section of a concrete form when assembled therewith, and modular V-shaped notches provided thereon along upper and lower surfaces providing locator means for enabling reinforcing rods to be carried in the turned up notches so that movement of the concrete reinforcing rods can be minimized as concrete is poured into the concrete form structure having one or more of the concrete reinforcing rods mounted therein.

19. A synthetic plastic concrete form tie comprising a pair of traingular truss sections disposed in end-to-end relation, the truss sections each defining triangular truss openings of sufficient size to permit concrete to flow laterally therethrough, an intermediate web section joining the truss sections at the apexes of traingles of the triangular truss sections, end attaching means at opposite end of the tie formed integral with opposite ends of the tie, said attaching means at each end being for anchoring the tie to opposed wall section of a concrete form when assembled therewith, modular V-shaped notches provided thereon along upper and lower surfaces providing locator means for enabling reinforcing rods to be carried in the turned up notches so that movement of the concrete reinforcing rods can be minimized as concrete is poured into the concrete form structure having one or more of the concrete reinforcing rods mounted therein, concrete tie locator means being provided along a top edge of the tie defining a V-shaped notch for receiving a concrete tie rod to resist movement of the concrete tie rod as concrete is poured thereon.

20. A method of securing a wall covering to a concrete wall structure, the steps of forming synthetic plastic wall forming sections from a foamed plastic material with rows of tie slots at spaced intervals along upper and lower edges and with indicia formed on outer wall suraces of the forming section so that the indicia and the slots are transversely aligned in pairs along the endges enabling the indicia to act as a tell tale for the slots and wall ties, securing opposite ends of synthetic plastic concrete wall ties in the slots of the wall forming sections to provide a reinforced form structure, securing transverse closure sections between the wall forming sections to provide form closures, pouring concrete in the thus formed concrete forming structure and immersing and hiding the ties in the concrete, screwing fasteners through a wall covering, the panel section into the wall tie using the indicia as a blind concrete tie locator for aligning the screw with the hidden wall tie enabling the screw to be screwed into the tie to securely fasten the wall covering thereto.

* * * * *